US007246471B2

(12) United States Patent
Riermann et al.

(10) Patent No.: US 7,246,471 B2
(45) Date of Patent: Jul. 24, 2007

(54) MODULAR ASSAULT COURSE

(76) Inventors: Fred Riermann, 1466 78th St., New Richmond, WI (US) 54017; Jonathan Riermann, 25900 Grafton Ave., Wyoming, MN (US) 55092

( * ) Notice: Subject to any disclaimer, the term of this patent is extended or adjusted under 35 U.S.C. 154(b) by 0 days.

(21) Appl. No.: 11/204,616

(22) Filed: Aug. 16, 2005

(65) Prior Publication Data

US 2006/0115796 A1 Jun. 1, 2006

Related U.S. Application Data

(62) Division of application No. 10/371,131, filed on Feb. 19, 2003, now abandoned.

(51) Int. Cl.
*E04B 1/00* (2006.01)
*E06B 9/00* (2006.01)

(52) U.S. Cl. ..... 52/283; 52/281; 52/282.4; 109/49.5; 273/410

(58) Field of Classification Search ..... 52/281, 52/282.1, 282.2, 282.3, 282.4, 283, 284; 273/410, 406, 358, 343; 109/49.5; 428/457, 428/137

See application file for complete search history.

(56) References Cited

U.S. PATENT DOCUMENTS

| | | | | |
|---|---|---|---|---|
| 3,974,608 | A * | 8/1976 | Grearson | 52/235 |
| 4,819,946 | A * | 4/1989 | Kahler | 273/404 |
| 4,856,791 | A * | 8/1989 | McQuade | 273/410 |
| 5,142,997 | A * | 9/1992 | DeLong et al. | 109/49.5 |
| 5,170,603 | A * | 12/1992 | Bartlett | 52/282.3 |
| 5,564,712 | A * | 10/1996 | Werner | 273/410 |
| 5,822,936 | A * | 10/1998 | Bateman | 52/281 |
| 6,009,790 | A * | 1/2000 | Tekorius | 89/36.02 |
| 6,253,516 | B1 * | 7/2001 | D'Andrea et al. | 52/582.1 |
| 6,401,427 | B1 * | 6/2002 | Snyder | 52/764 |
| 2006/0115796 | A1 * | 6/2006 | Riermann et al. | 434/11 |
| 2006/0234069 | A1 * | 10/2006 | Sovine et al. | 428/457 |

* cited by examiner

*Primary Examiner*—Carl D. Friedman
*Assistant Examiner*—Tan Le
(74) *Attorney, Agent, or Firm*—Jacobson and Johnson

(57) ABSTRACT

A panel for field erecting an assault course with the panel supporting a bullet retaining member on at least one face with the panel erectable on a base member and securable to similar or identical panels to form an assault course and a method for field erecting of the assault course comprising the laying of a base member on top of a terrain surface and then erecting a walled enclosure around the perimeter by positioning the panels on top of the base and then securing the panels to each other and to the base member with fasteners to form the assault course.

9 Claims, 4 Drawing Sheets

MODULAR ASSAULT COURSE

CROSS REFERENCE TO RELATED APPLICATIONS

This application is a divisional of prior application Ser. No. 10/371,131 filed on Feb. 19, 2003 now abandoned titled Modular Assault Course.

FIELD OF THE INVENTION

This invention relates generally to assault courses and, more specifically, to components to permit field erecting of an assault course as well as a method of assembling an assault course on a training site and a method of repair and replacement of components of the assault course as the components deteriorate under use.

STATEMENT REGARDING FEDERALLY SPONSORED RESEARCH OR DEVELOPMENT

None

REFERENCE TO A MICROFICHE APPENDIX

None

BACKGROUND OF THE INVENTION

Assault courses for training combat personnel generally comprise an open top walled structure, which is laid out in a floor plan of a typical house or building located in enemy territory. The purpose of the assault course is to simulate combat field conditions for a trainee who might eventually have to find and capture enemy personal hiding within a building. Since training of the personnel can require the personnel to quickly fire their weapon as they enter a room it is necessary to have the walls of the assault course able to withstand the impact of multiple rounds of ammunition as well as to retain the bullets that impact against the wall in order to prevent ricocheting bullets from injuring the trainees.

In order to build an assault course, a concrete foundation is first laid in the terrain. Next, concrete walls are poured to form the external perimeter walls as well as any interior walls of the assault course. In the final step the walls are covered with material to absorb and capture any bullets or fragments that might ricochet off the walls.

While such systems function well for permanent assault course training facilities it is difficult to erect such assault courses in the field where the potential special forces need field training on how to capture enemy personal hiding in local buildings. For example, if military forces are quickly brought into an area there may be an urgent need to quickly train the military forces under field conditions that includes the types of buildings that enemy forces might be hiding in. Oftentimes environment conditions can preclude the quick erecting of an assault course. For example, the weather may be to cold to pour concrete or the soil may be difficult to lay a foundation. A further drawback is that once the concrete assault course is built it becomes a permanent part of the landscape and cannot be moved to another location.

The present invention comprises a set of modular panels that can quickly be erected and assembled to form an assault course with the use of simple mechanical tools. If the panels are large military personal can use a mobile crane to position the panels in an upright condition to form the assault course.

Once positioned, each of the panels is secured to a base through removable fasteners such as bolts and nuts. On the other hand if the panels are small military personal can lift and position both the base member and the panels without the aid of a crane; however, for larger panels cranes can be used to hoist the panels into position.

The present invention includes a set of modular panels, having a core that cannot be penetrated by a bullet with the modular panel assembleable into an assault course having a bullet retaining material secured to at least one face of each of the panels. The panels are positioned in a side-to-side condition so that the bullet-retaining member on one panel extends into abutting engagement with the bullet-retaining member on an adjacent panel so as not to form a gap therebetween.

In order to permit the bullet retaining materials to be secured to the panel under adverse environmental condition a set of spikes are mounted to the surface of the panel. In order to retain bullets and prevent ricocheting thereof an elastomer bullet-retaining member is removable secured to the face of the panel by forcing the spikes into the elastomer to hold the elastomer in position during field training in the assault course.

A further feature of the invention, in contrast to concrete cast assault courses, is that if either a panel or a bullet retaining member becomes significantly damaged by repeated firings the panel and bullet retaining member can be easily replaced and be in a condition for use without having to wait for concrete to cure.

SUMMARY OF THE INVENTION

Briefly, the present invention comprises a set of components including modular panels, base members and bullet retaining members and fasteners for field assembly of an assault course as well as a method of repairing an assault course with the use of simple tools such as wrenches. The components include panels with replaceable bullet retaining members that are quickly attached to the panels through a set of spikes that are fixedly secured to the panel.

DESCRIPTION OF THE PREFERRED EMBODIMENT

Figure 1:
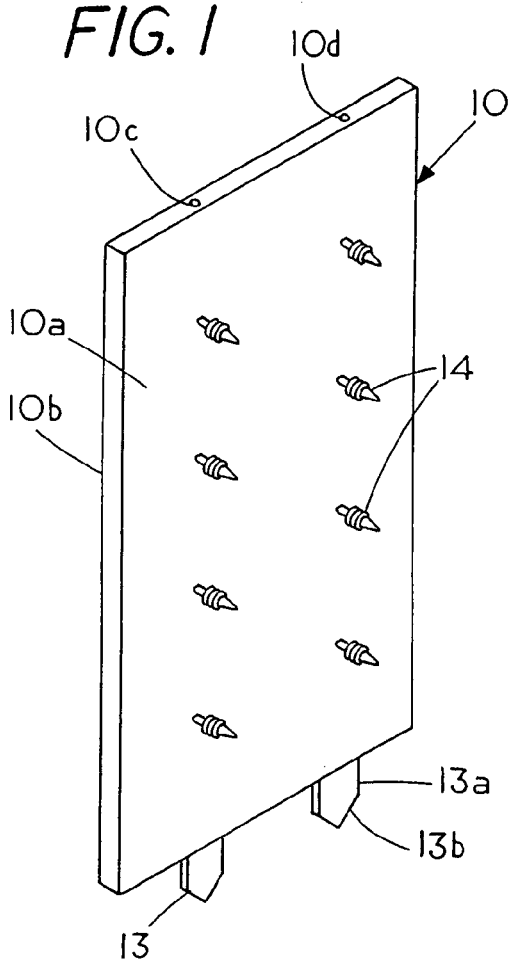
FIG. 1 is a perspective view of a modular panel for constructing an assault course.

FIG. 1 is a perspective view of a modular flat perimeter panel 10 for constructing an assault course. Modular panel 10 has a front side 10*a* and a back side 10*b*. Located on the lower end of panel 10 is a first locating member 13 and a second locating member 13*a*. Locating members 13 and 13*a* each have a wedge shape end to assist in guiding modular panel 10 into an assembled condition on a base member. Located on the top end of panel 10 is a first threaded recess 10*c* and a second threaded recess 10*d*. The threaded recesses provide a dual function. The threaded recesses can be used to secure a hook or eye bolt thereto to enable the panel to be lifted into position using the hook or eye bolt. Once in position the hook or eye bolt is removed and a top securement member can be secured to the top end of the panels to hold the panels in top alignment with each other.

Located on the front face of modular panel 10 is a set of retaining spikes 14 for holding a bullet-retaining member thereon. In the embodiment shown retaining spikes 14 are welded to face 10*a* and extend perpendicularly therefrom in a condition for receiving and holding a bullet retaining member thereon.

In the embodiment shown modular perimeter panel 10 comprises a rectangular 4 foot by 8 foot steel plate having a thickness of ⅜ of an inch. Panel 10 has a Brinell hardness of 500. The size and hardness of the steel panel is selected based on the type of assault course that is to be built as well as the type of weapons used in training. That is, in general the thickness and hardness of the steel plate is dependent on the caliber of the weapon as well as the type of bullet with the panel and needs to be sufficiently hard so as to prevent penetration of a bullet fired at the panel. As described above a ⅜ inch steel panel having a Brinell hardness of 500 prevents a steel cased 7.62 caliber bullet from penetrating therethrough. The thickness and hardness of metal plates to withstand other types of ammunition can be experimentally determined by firing rounds at a metal plate to determine if the metal plate has sufficient thickness and hardness to prevent bullet penetration.

Figure 2:
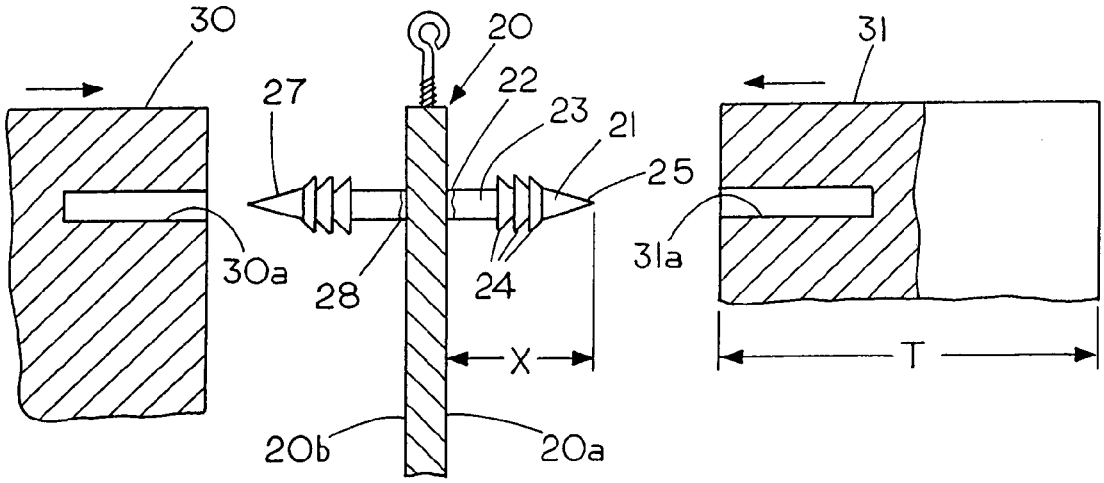
FIG. 2 is a side view of a portion of a modular panel positioned between two bullet retaining members.

FIG. 2 shows a partial side view of an interior modular panel 20 having a first face 20*a* and a second face 20*b*. Located on face 20*a* is a retaining spike 21 that is held on panel 20 by a weld 22. Retaining spike 21 includes a shank 23, a set of concentric circular retaining shoulders 24 and a conical tip 25. Located on the opposite face 20*b* is an identical retaining spike that is held on panel 20 by a weld 28. Since the spikes of the present invention are identical only one of them is described herein.

Interior modular panel 20 differs from perimeter modular panel 10 in that interior modular panel 20 includes retaining spikes on opposite faces so that a bullet retaining member can be secured to each face of panel 20.

In order to illustrate how bullet retaining members are held in position on interior modular panel 20 a first bullet retaining member 30 is shown partial in section and proximate spike 27 and a second bullet retaining member 31 is shown is shown partial in section and proximate spike 21 on the opposite side of interior modular panel 20.

Bullet retaining member 30 includes a preformed pilot hole 30*a* for receiving spike 27, which has a diameter smaller than the diameter of the retaining shoulders on the retaining spike 27. Similarly, bullet-retaining member 31 includes a preformed pilot hole 31*a* for receiving spike 25, which has a diameter smaller than the diameter of the retaining shoulders on the retaining spike 21.

In assembling of the assault course the bullet retaining member 30 is deformably forced onto spike 27 and is held in place by the retaining shoulders thereon. Similarly, the bullet-retaining member 31 is deformably forced onto spike 21 and is held in place by retaining shoulders thereon. Thus the spikes can provide the sole support for holding the bullet retaining material in place.

In the embodiment shown the length of the retaining spike is indicated by x and T indicates the thickness of the bullet-retaining member. In order not to have the end of the retaining spike extend beyond the bullet-retaining member 31 or 30 the thickness of the bullet retaining members should exceed the length L of the bullet retaining spikes. In the embodiment shown the bullet retaining material comprises a high density recycled rubber material that retains the bullets that penetrate therethrough and are stopped by the metal panel. Such material is commercially available and is sometimes referred to as ballistic tile.

A feature of the bullet retaining members is that an individual bullet-retaining member is replaceable if it should deteriorate due to repeated firings. That is, to replace a bullet-retaining member one only needs to pull the bullet-retaining member free of the retaining spikes and replace the deteriorated bullet-retaining member with a new bullet-retaining member. A benefit of the mechanical engagement between the bullet-retaining member and the spikes is that the bullet retaining panels can be quickly detached or attached under any type of environmental conditions since cure times are not involved in securing the bullet retaining member to the panel.

Figure 3:
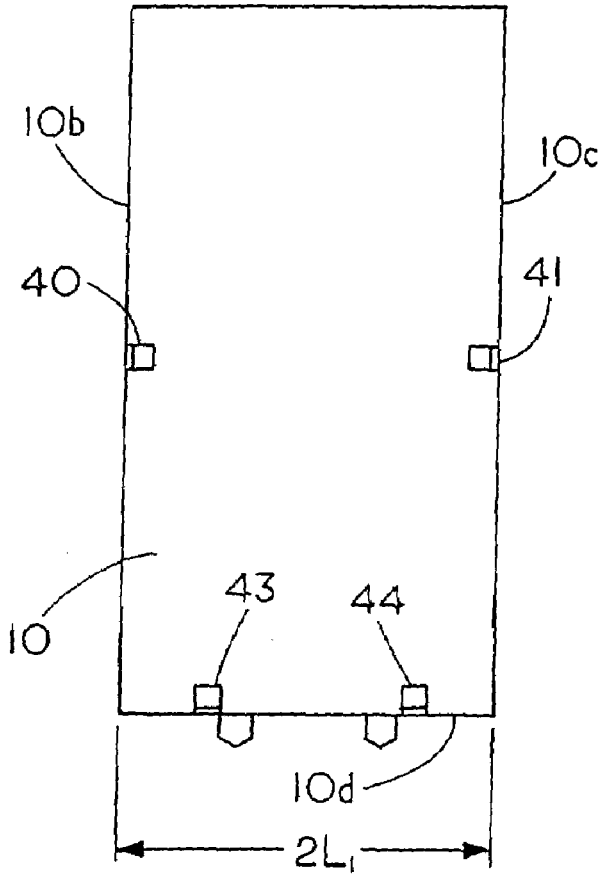
FIG. 3 is a back view of a perimeter modular panel.

FIG. 3 shows a back view of perimeter panel 10 revealing a first lateral flange 40 located proximate edge 10*b* and a second lateral flange 41 located proximate edge 10*c*. Located proximate bottom edge 10*d* is a first base flange 43 and a second base flange 44. Perimeter panel 10 has a width designated $2L_1$.

Figure 4:
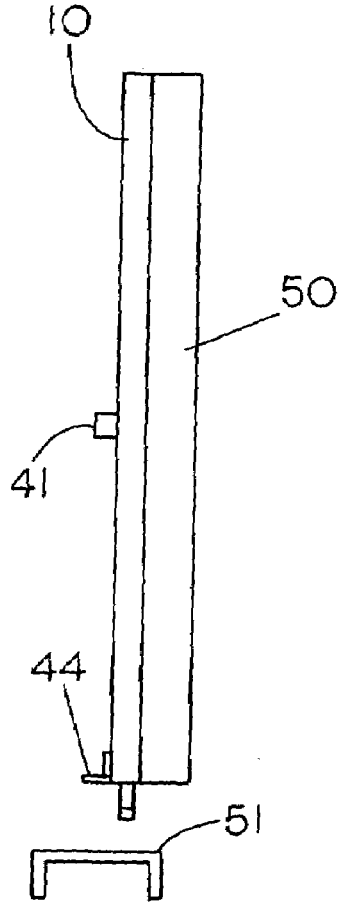
FIG. 4 is a side view of the perimeter modular panel of FIG. 3.

FIG. 4 is a side view of panel 10 showing a bullet retaining member 50 secured thereto. For illustrating the assembly process the perimeter modular panel 10 is positioned above an elongated base comprising a channel member 51.

Figure 5:
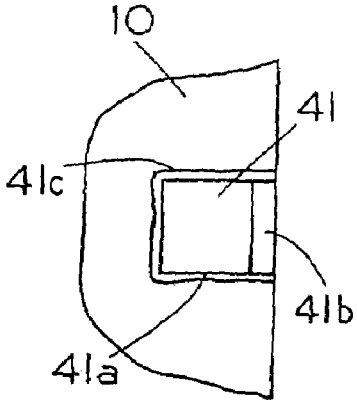
FIG. 5 is a partial view of the panel of FIG. 3 showing the lateral flange.

In order to understand the field erectability of the present invention reference should be made to FIG. 5 which shows a portion of panel 10 revealing a flange 41 that is secured to plate 10 by a weld 41*c*. Flange 41 comprises a right angle flange having a first leg 41*a* that is permanently attached to plate 10 and a second leg 41*b* that extends perpendicularly therefrom with leg 41*b* having an opening 41*d* for extending a fastener such as a bolt therethrough.

Figure 6:
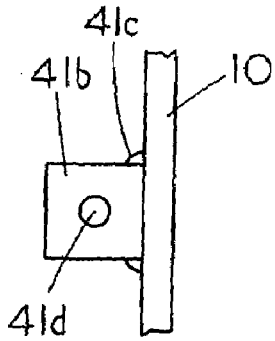
FIG. 6 is a side view of the lateral flange of FIG. 5 showing the hole in the flange to permit securement to another panel.

Similarly, FIG. 6 shows a side view of a portion of plate 10 with the flange 41 having an opening 41*d* for passing a removable fastener therethrough. In the preferred embodiment a fastener such as a bolt is extend through opening 41*d* in flange 41 and through a similar opening in a flange on an adjacent panel. A nut is then secured to the bolt and the adjacent panels are brought into a side by side relationship to each other where they are maintained by the fastener.

Figure 7:
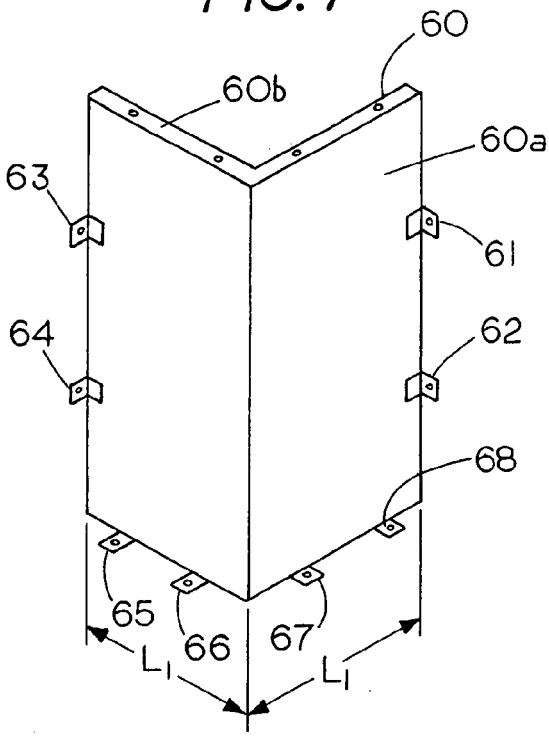
FIG. 7 is a perspective view of a right angle perimeter panel forming a corner support on an assault course.

FIG. 7 shows a further component comprising a modular perimeter corner panel 60 having a first section 60*a* located at a right angle to a second section 60*b*. A set of lateral securement flanges 61 and 62 are located on panel 60*a* and similarly a set of securement flanges 63 and 64 are located on the opposite panel 60*b*. The purpose of having a panel with a preformed angle between adjacent sections is to enable one to quickly build a corner section of an assault course. That is, once the corner modular panel 60 is placed in position on a base the corner panel can form a reference for the remaining portion of the assault course. In order to secure the corner modular panel in position there are included a set of base flanges 65, 66, 67 and 68, which can be secured to a base member with a removable fastener such as a bolt. In the preferred embodiment the base includes a set of threaded recesses so a bolt can be extended through the openings in the flanges and rotated to bring the flange and the modular panel into a fixed upright condition on the base member. While the corner modular panel is shown with a right angle corner other angled corners can be formed by joining the edges of the panel to each other at an angle of 180 degrees or less. Preferably, the edges of the panel are welded to each other during the manufacturing process so that when taken to the field they can be quickly erected as a corner section for the assault course.

Figure 8:
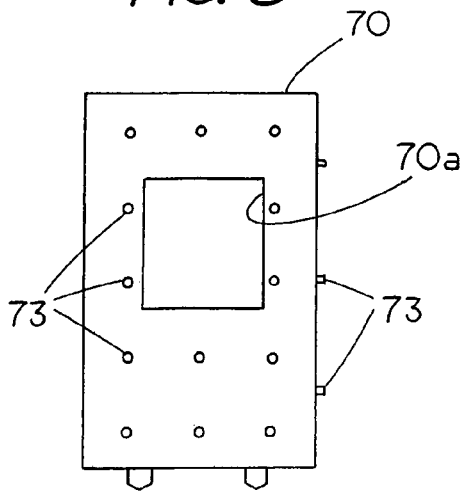
FIG. 8 is a front view of an interior modular panel having a window opening therein.

A further feature of the field erectable modular assault course is that special features can be incorporated into the panel. FIG. 8 shows such special feature, namely, a metal plate 70 having an opening 70*a* therein to resemble a window opening. Located on the face of plate 70 is a set of retaining spikes 73 for holding a bullet-retaining member thereon. In this embodiment retaining spikes 73 are also positioned on the edge face of plate 70 so that the edge face 70 can be covered with a bullet retaining material.

Figure 9:
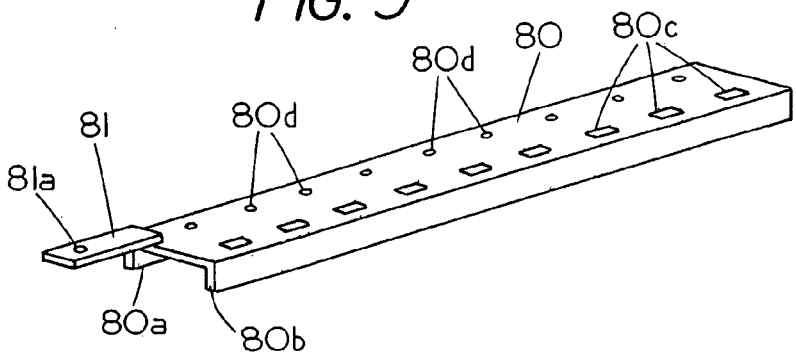
FIG. 9 is a perspective view of a base member for supporting the modular panels.

FIG. 9 shows a portion of an elongated base member for supporting the modular panels in an upright condition. Base member 80 comprise a U-shaped channel member having a first leg 80*a* and a second leg 80*b* with a smooth top surface 81 for placement of modular panels thereon. Located in top of base member 80 are a set of location holes 80*c* that are positioned to receive the locating members extending from the bottom of the modular panels. That is, in the assembling of the assault course one need only place the locating members on the bottom of the panels in the location holes in base member 80 in order to obtain proper alignment. Located along the opposite side of base member 80 is a set of threaded recesses for receiving a stud fastener. During assembly of the assault course the base flanges are positioned over the threaded recesses so that a stud bolt can be inserted through the hole in the base flange and then into a threaded recess where the stud bolt is rotated to hold the modular panel in position.

Base member 80 is shown comprising an elongated section that has an extension 81 with an opening 81*a* therein to permit the securement of the base member 80 to an adjacent base member. In order to provide a right angled corner with adjacent base members the end surface of the base member can be mitered at a 45 degree angle so as to mate with a similar mitered base member to create a right angle corner. Similarly, other corners can be precut with the proper corner angle before the base member is brought to the erection site.

Figure 10:
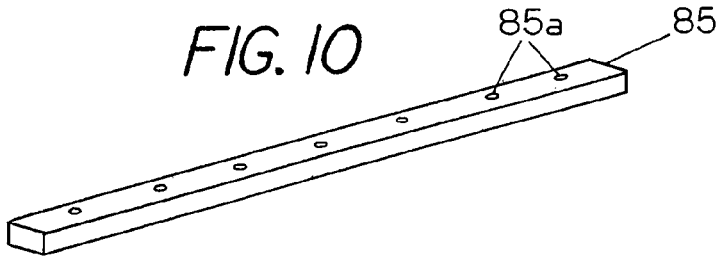
FIG. 10 is a perspective view of a top securement member for securing adjacent modular panels to each other.

FIG. 10 is a perspective view of a top securement member 85 for securing the top of adjacent modular panels to each other. Top securement member 85 comprises a rigid member such as a steel bar that has a set of spaced openings 85*a* located therein. The distance between holes is such that when the bar 85 is placed on the top end of a modular panel the openings are in alignment with the threaded recesses in the top of the modular panels. Once in alignment fasteners such as stud bolts are inserted through the top securement member and into the threaded recesses (see FIG. 1) on the top of the modular panels. By drawing the stud bolts into tight engagement with the modular panels the top of the panels are rigidly tied together to hold the modular panels in an erect condition. In addition, by extending the top securement member onto the corner modular panels one can tie the entire top of the modular panels together to provide an upright structure capable of withstanding the impact of multiple rounds.

Figure 11:
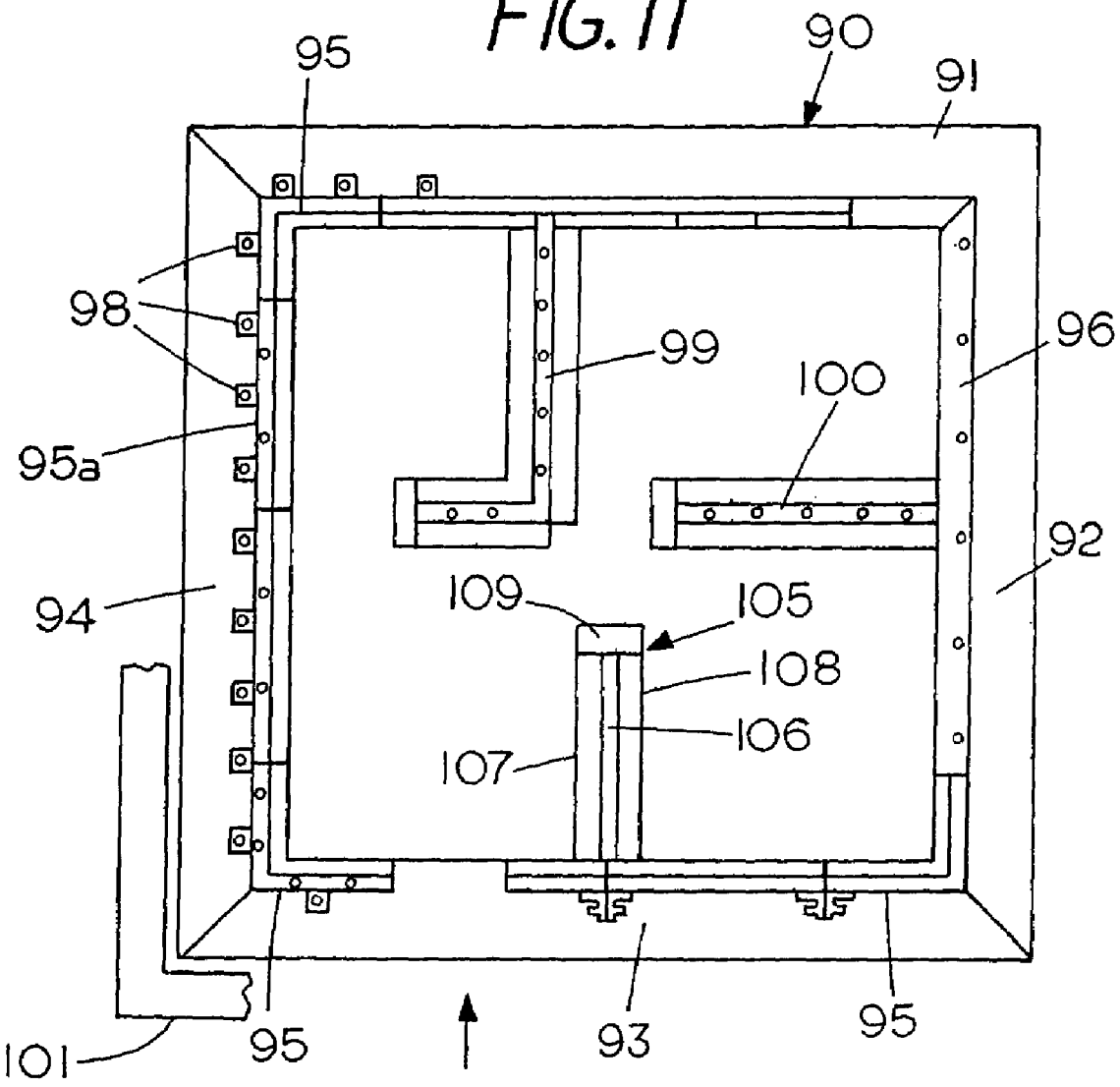
FIG. 11 is a top view of a partially assembled assault course showing a floor plane of the assault course.

FIG. 11 is a top view of a partially assembled assault course 90. Assault course 90 comprises a first elongated base member 91 that is joined on one end to elongated base member 92 and on the opposite end to base member 94. Similarly, a second elongated base member 93 is joined on one end to base member 92 and on the other end to base member 94 to complete the assault course. A set of flanges 98, which are shown on only one side for clarity, extend around each of the modular panels and are secured to base members to hold the modular panels in an upright condition.

In order to illustrate the securement of the top of the modular panels to each other FIG. 11 shows top securement members 99 and 100 holding the top of the panels to each other. In the embodiment shown a cap 96 can be attached to the modular panels to form a further top support for the panels.

As evident from FIG. 11, the interior panels, such as on wall 105, have a metal core 106 with a bullet retaining member 107 secured to one face and a bullet retaining member 108 secured to the opposite face. A third bullet retaining member 109 is secured to the end of the metal core to cover the exposed edge of meal core 106 to thereby prevent a bullet from ricocheting and injuring a trainee in the assault course.

In order provide for observing the trainees a platform or catwalk 101 can be placed around the peripheral region of the assault course and supported by the base and sidewall through braces extending therefrom.

Thus FIG. 11 shows a top view of a partially assembled modular assault course 90 having fastener joined elongated base members 91, 92, 93 and 94 with each of the base members having a top surface for panel support and a bottom surface for ground engagement with the top surface having locating holes therein as well as threaded recesses for receiving a stud bolt. Located on top of the base members are a plurality of panels 95 and 95*a* with each of the panels having a front side, a back side a first end and a second end. The first end or bottom end includes, a pair of locating members such as members 13 and 13*a* (see FIG. 1) thereon for engagement with the locating holes 80*c* (see FIG. 9) in the top surface of the base members to enable a plurality of panels to be positioned in an upright condition on the elongated base member. A set of base flanges 98 are secured to the back side of perimeter panels and have an opening therein (see FIG. 7) for extending a fastener through the base flange and into the base member to hold the panel in an upright condition. In addition to the base fasteners there are included lateral flanges (40, 41 see FIG. 3), that are secured to a first side of an adjacent panel, with each of the lateral flange having an opening therein for extending a fastener, such as a threaded bolt therethrough for engagement with a nut to secure each of the panels to an adjacent panel.

Each of the panels include a plurality of spikes extending from the panel (see FIG. 1 and FIG. 2) with the plurality of spikes having a conical point with a retaining shoulder thereon (see FIG. 2);

Removeably secured to the spikes is a bullet retaining member comprising a rubber mat having a thickness larger than a length of the plurality of spikes to enable penetrating securement of said rubber mat to said plurality of spikes (see FIG. 2) to thereby hold rubber mat on the front surface of panel.

The assault course can include a plurality of additional panels, each having a bullet retaining member comprising a rubber mat with the plurality of additional panels arranged in a side by side condition to form an interior wall with each of the additional interior panels having a bullet retaining member with a metal support plate or core that allows the bullet retaining member to penetratingly receive and hold a round of ammunition fired therein. Thus each of the mats on each of the panels coact with the metal core to prevent penetration thereof by the bullet. In addition, the bullet retaining members, while permitting penetration by a bullet are sufficiently dense so as to absorb a bullet that might ricochet off the panel.

Thus the present invention comprises a method of erecting an assault course comprising the steps of: placing a base on top of a surface; forming the base into a perimeter support; placing a set of panels each having at least one bullet retaining member thereon on top of said base; and securing the panels to said base and to each other to form the perimeter of an assault course.

We claim:

1. An on-the-go field erectable assault course comprising:

a first plurality of panels arrangeable in a closed perimeter, each of said plurality of panels having a bullet-retaining member secured thereto;

a base for supporting said plurality of panels, said base supporting said plurality of panels in an erect condition;

a second plurality of panels, said second plurality of panels having a bullet retaining member on opposite faces thereof, said second plurality of panels positioned within the closed perimeter to form a divider wall for preventing penetration of a bullet from either side of said divider wall; and fasteners for securing the first plurality of panels to said base.

2. The on-the-go field erectable assault course of claim 1 including a set of securement members holding each of the panels in a fixed upright condition.

3. The on-the-go field erectable assault course of claim 2 including at least one panel with an opening therein for entry by a person.

4. The on-the-go field erectable assault course of claim 3 including a top securing member for securing a top of each of the panels in the upright condition.

5. The on-the-go field erectable assault course of claim 4 including a set of bolt fasteners for securing each of the panels to said base and to said top securing member.

6. The on-the-go field erectable assault course of claim 1 including a catwalk extending around the perimeter of the enclosure to permit a person to view assault activities within the enclosure.

7. The on-the-go field erectable assault course of claim 1 wherein the base comprises an elongated member having a length greater than the width of each of said panels to thereby enable the base to support a portion of at least two panels.

8. The on-the-go field erectable assault course of claim 1 wherein each of the panels are metal panels having a Brinell hardness of at least 500.

9. An on-the-go field erectable assault course comprising:

a plurality of panels, each of said plurality of panels having a bullet-retaining member secured thereto;

a base for supporting said plurality of panels, said base supporting said plurality of panels in an erect condition;

a catwalk extending around the perimeter of the enclosure to permit a person to view assault activities within the enclosure; and fasteners for securing the plurality of panels to said base.

* * * * *

UNITED STATES PATENT AND TRADEMARK OFFICE

CERTIFICATE OF CORRECTION

PATENT NO. : 7,246,471 B2
APPLICATION NO. : 11/204616
DATED : July 24, 2007
INVENTOR(S) : Fred Riermann and Jonathan Riermann It is certified that error appears in the above-identified patent and that said Letters Patent is hereby corrected as shown below:

Column 8, line 32, claim 9 “the perimeter” should read --a perimeter-- and “the enclosure” should read --an enclosure--.

Signed and Sealed this

Sixth Day of November, 2007

JON W. DUDAS
*Director of the United States Patent and Trademark Office*